US005620332A

United States Patent [19]

Gerke et al.

[11] Patent Number: 5,620,332

[45] Date of Patent: Apr. 15, 1997

[54] TERMINAL ELEMENT

[75] Inventors: Dieter Gerke; Manfred Müller; Harald Bülow, all of Berlin, Germany

[73] Assignee: Krone Aktiengesellschaft, Berlin-Zehlendorf, Germany

[21] Appl. No.: 513,535

[22] Filed: Aug. 10, 1995

[30] Foreign Application Priority Data

Aug. 10, 1994 [DE] Germany ..... 44 37 022.9

[51] Int. Cl.[6] ..... H01R 4/24

[52] U.S. Cl. ..... 439/417

[58] Field of Search ..... 439/402.3, 412.13, 439/417

[56] References Cited

U.S. PATENT DOCUMENTS

| | | | |
|---|---|---|---|
| 4,037,905 | 7/1977 | Lucas | 439/402 |
| 4,171,857 | 10/1979 | Forberg et al. | 439/402 |
| 4,279,460 | 7/1981 | Forberg | 439/402 |
| 4,701,138 | 10/1987 | Key | 439/417 |
| 4,722,699 | 2/1988 | Heng et al. | 439/402 |
| 4,764,125 | 8/1988 | Debortoli | 439/403 |
| 5,118,305 | 6/1992 | Hell et al. | 439/417 |
| 5,240,432 | 8/1993 | Daoud | 439/417 |
| 5,399,099 | 3/1995 | English et al. | 439/417 |
| 5,417,581 | 5/1995 | Dechelette et al. | 439/417 |

FOREIGN PATENT DOCUMENTS

| | | | |
|---|---|---|---|
| 26230224A1 | 5/1989 | France . | |
| 9313797 U | 9/1993 | Germany | H01R 4/24 |

*Primary Examiner*—P. Austin Bradley
*Assistant Examiner*—Jill DeMello
*Attorney, Agent, or Firm*—McGlew and Tuttle

[57] ABSTRACT

The present invention relates to a terminal element including electrical contacts in insulation displacement technique in chambers of a receiving part for the strapless connection of conductors. The terminal element defines openings for receiving the electrical conductors. A chamber of a receiving part includes at least one opening for the introduction of a conductor. A sliding part surrounding a part of an insulation displacement contact element disposed in the chamber. The sliding part has an opening coinciding in one position of the sliding part with the opening in the receiving part, with the opening in the chamber and with the contact zone of the insulation displacement contact element. The closing part includes a device accessible from outside for moving the sliding part.

17 Claims, 5 Drawing Sheets

TERMINAL ELEMENT

FIELD OF THE INVENTION

The present invention relates to a terminal element with an insulation displacement contact, and in particular the present invention relates to a terminal element with a slider that holds a conductor and moves the conductor into a contact slot of the insulation displacement contact.

BACKGROUND OF THE INVENTION

In the German Patent Office publication DE-GM 93 13797, a terminal block is described for the connection of insulated electrical wires to electrical contacts by an insulation displacement technique by means of a closing plug. At the top of the terminal block there are provided open chambers and blocks configured with through-passing insulation displacement contacts in a 45 degree position and allowing a two-side connection of the terminal block. Connection is performed on the user side by means of the closing plugs belonging to the terminal block.

A contact is achieved by the movement of the closing plug being pressed through with the fingers, which for larger wire diameters and repeatedly performed connections and disconnections will lead to fatigue problems of the user.

SUMMARY AND OBJECTS OF THE INVENTION

It is therefore the object of the invention to develop a terminal element of the type referred to hereinbefore that permits an easy and reliable connection without a special connection tool.

The present invention contains a housing which defines a chamber. Inside the chamber is an insulation displacement contact (IDC) element. The IDC element defines a contact slot and an access portion. A slider is movably positioned in the chamber between a first position and a second position. The slider defines a slider opening for receiving a conductor. The housing also defines a housing opening for receiving a conductor. In the first position of the slider, the slider opening is positioned adjacent the housing opening and the access portion of the IDC element. In the second position of the slider, the slider opening is positioned adjacent the contact slot of the IDC element. A movement means is provided for moving the slider from the first position to the second position thereby moving any conductor in the openings into the contact slot and forming a connection of the conductor to the IDC element. The housing opening can also include means for holding the wire securely to the housing when the slider is in the second position. The movement means, for moving the slider, can either be a notch and an opening in the housing, or an arm connected to the slider and extending outward from the housing.

The insertion of a sliding part, movable from outside, into the chamber of the receiving part is performed such that with the movement of the sliding part, the conductor introduced from outside into the contact slot of the insulation displacement contact element is moved along and contacted there. Thereby a simple and reliable connection and disconnection of the insulation displacement contact elements of disconnector and connector blocks is possible without a special connection tool and without a larger force exertion just by means of an arbitrary lever, e.g. a screwdriver, a suitable sharp object or the like. Larger wire diameters can also repeatedly be connected, without the user getting tired by the force to be exerted.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
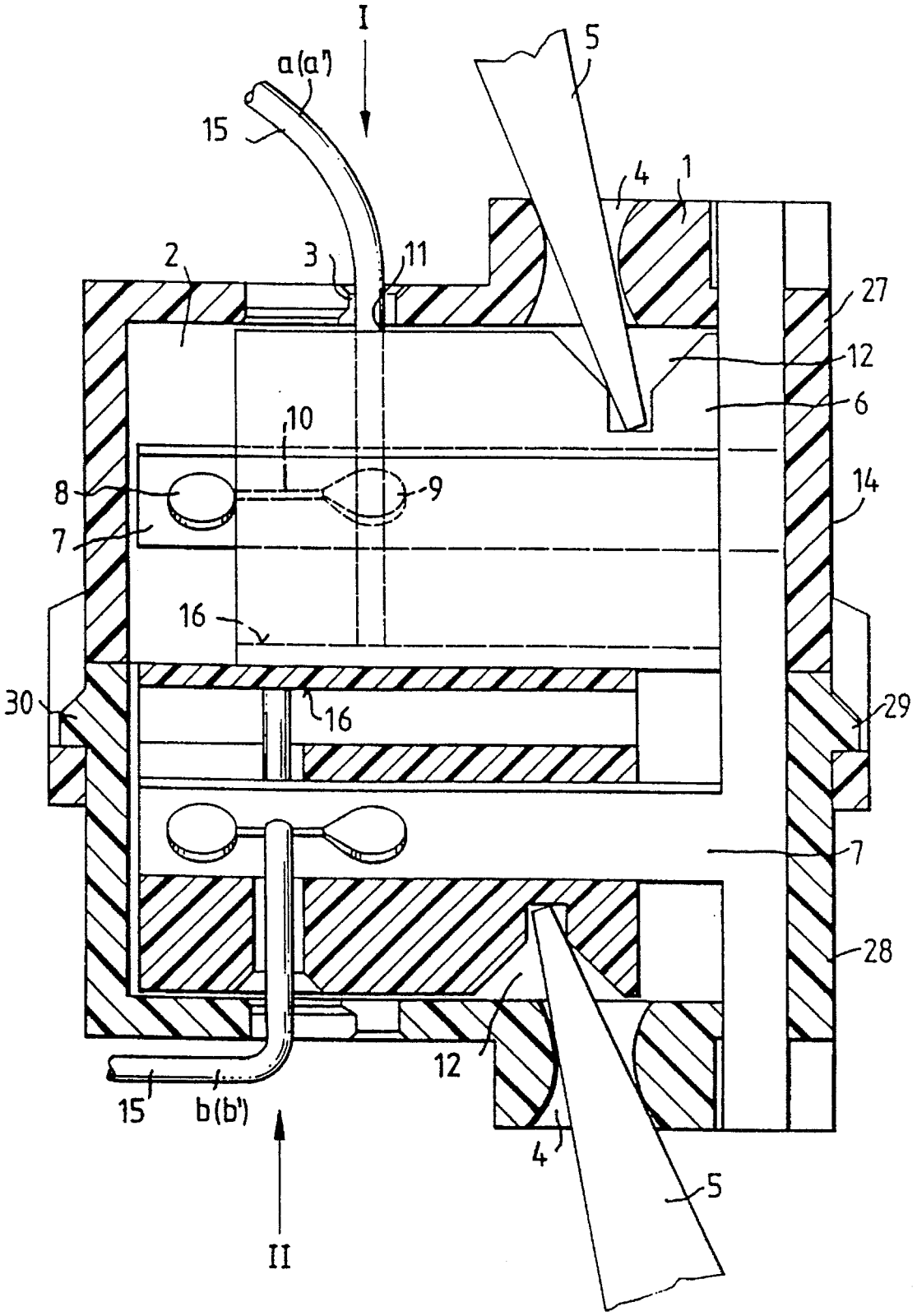
FIG. 1 is a sectional representation of the terminal element.

Referring now to FIG. 1, the terminal element is composed substantially of a receiving part or housing 1 formed of the parts 27, 28 being connected to each other by latch devices 29, 30. A chamber 2 with two insulation displacement contact elements or IDCs 7 is positioned and surrounded by a sliding part or slider 6 such that the contact zones for the cable wires a, b and a', b', respectively, are surrounded by one of the sliding parts 6. The slider and the IDC form a means for connection and disconnection of the conductor and the IDC. The insulation displacement contact element 7 is preferably disposed in a 45 degree position. The side 14 of the terminal element is configured for receiving the connection or disconnection device. The sliding part 6 has a funnel-shaped notch 12 forming a movement means by which the sliding part 6 is moved from the outside.

For wiring the terminal element, the sliding part 6 is brought into a connection position I by a lever 5, e.g. a screwdriver fitted through a movement opening 4 in the receiving part 1 and into the notch 12 of the sliding part 6. In the connection position I, an opening 3 in the receiving part 1, an opening 11 in the chamber 2, and a borehole or access portion 9 of the insulation displacement contact element 7 coincide. An electrical conductor 15, e.g. the cable wire a of a telecommunication cable, can be introduced up to a stop wall 16 at the sliding part 6.

After introduction of the electrical conductor 15 into the opening 3 of the receiving part 1 up to the stop at the stop wall 16, the sliding part 6 is moved by means of the inserted lever 5 leftwardly into position II. The introduced electrical conductor 15 is moved out of the borehole 9 of the insulation displacement contact element 7 and into the contact slot 10 of the insulation displacement contact element 7. The electrical conductor 15 then contacts the contact slot. In this position II, the sliding part 6 is latched in the chamber 2, in order to avoid unintended release (not shown). When disconnecting, the latching is released, and the sliding part is moved back into the first position I. The conductor 15 is also moved back into the borehole 9 of the insulation displacement contact element 7, from which the conductor can be removed.

FIG. 1 shows a possible embodiment of the terminal element adapted as a connector block.

Figure 2:
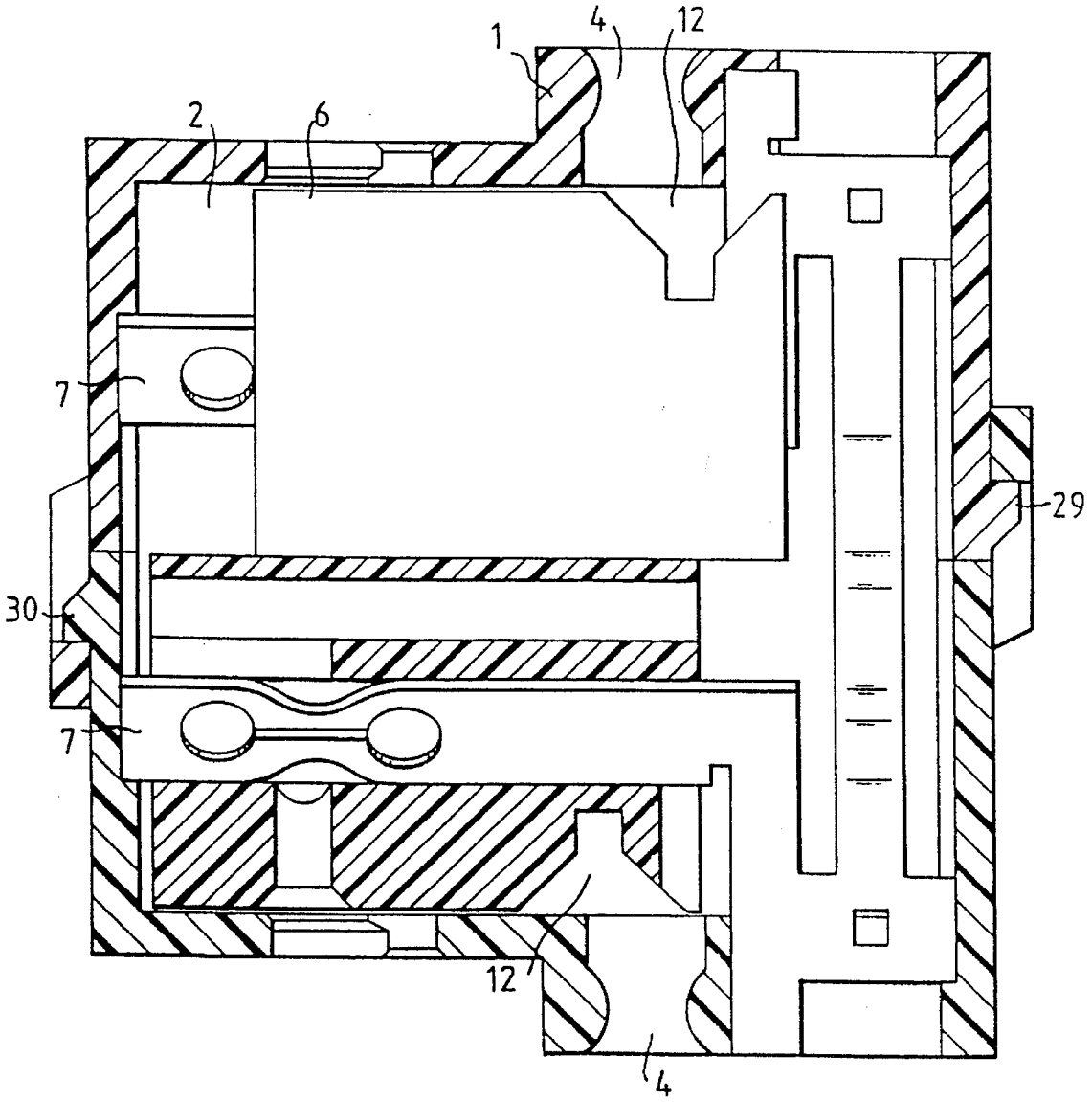
FIG. 2 is a representation of the terminal element for a disconnector block.

FIG. 2 shows the terminal element for a disconnector block. This embodiment differs from that of FIG. 1 only by the configuration of the insulation displacement contact element 7 and the constructional conditions related thereto in the disconnection zone. Connection and disconnection of cable wires takes place according to the functional principle described with reference to the embodiment of FIG. 1.

Figure 3:
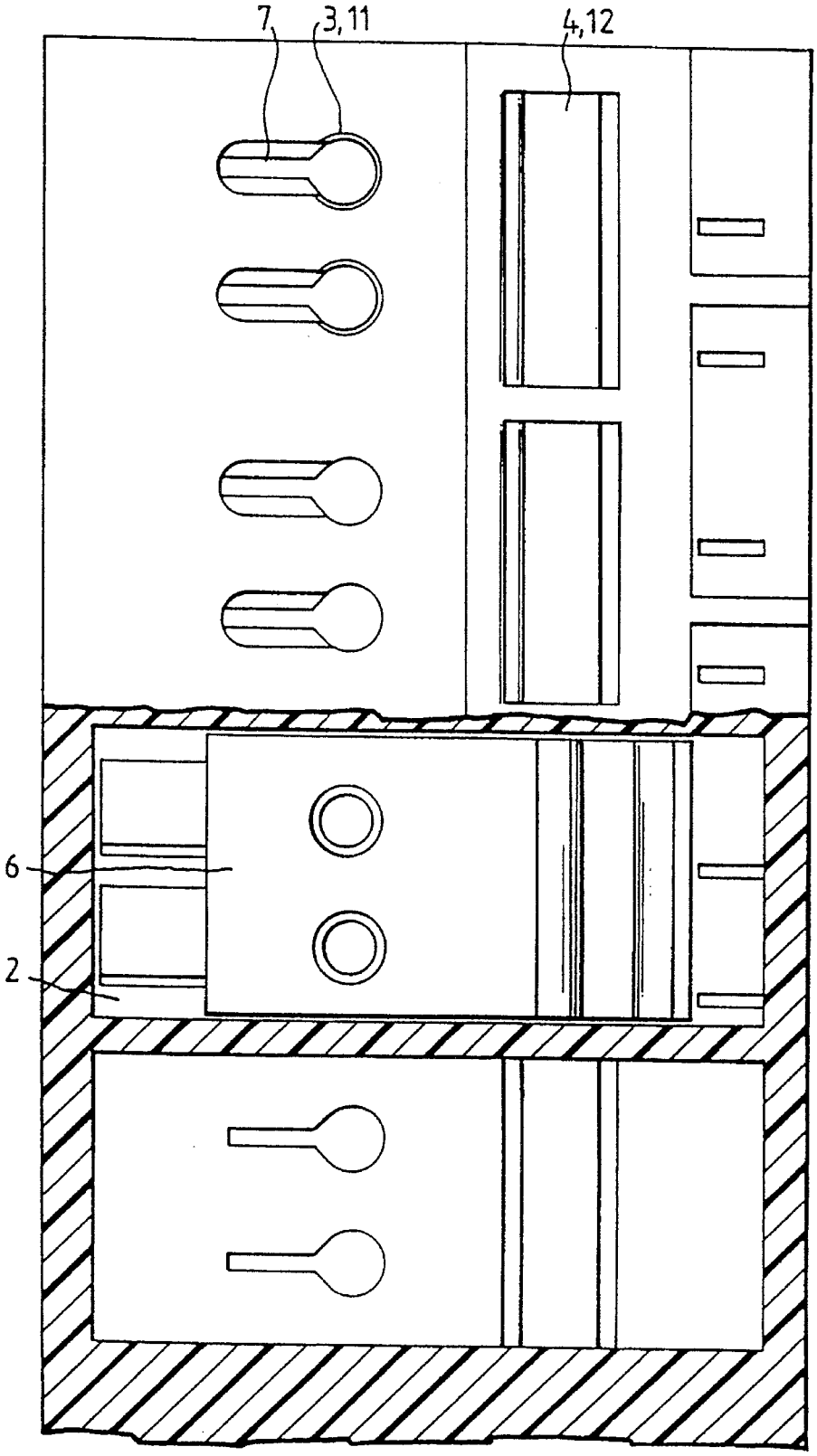
FIG. 3 is a top view of a series of several terminal elements.

FIG. 3 shows a top view the connection of several terminal elements on a block. From this view the position and the shape of the notch 12 of the sliding part 6 can be seen. Any number of terminal elements can be lined up. For an 8-DW or 10-DW block, the elements are arranged in series of eight or 10 terminal elements, resp. One terminal element serves for the connection of one DW (double wire).

Figure 4:
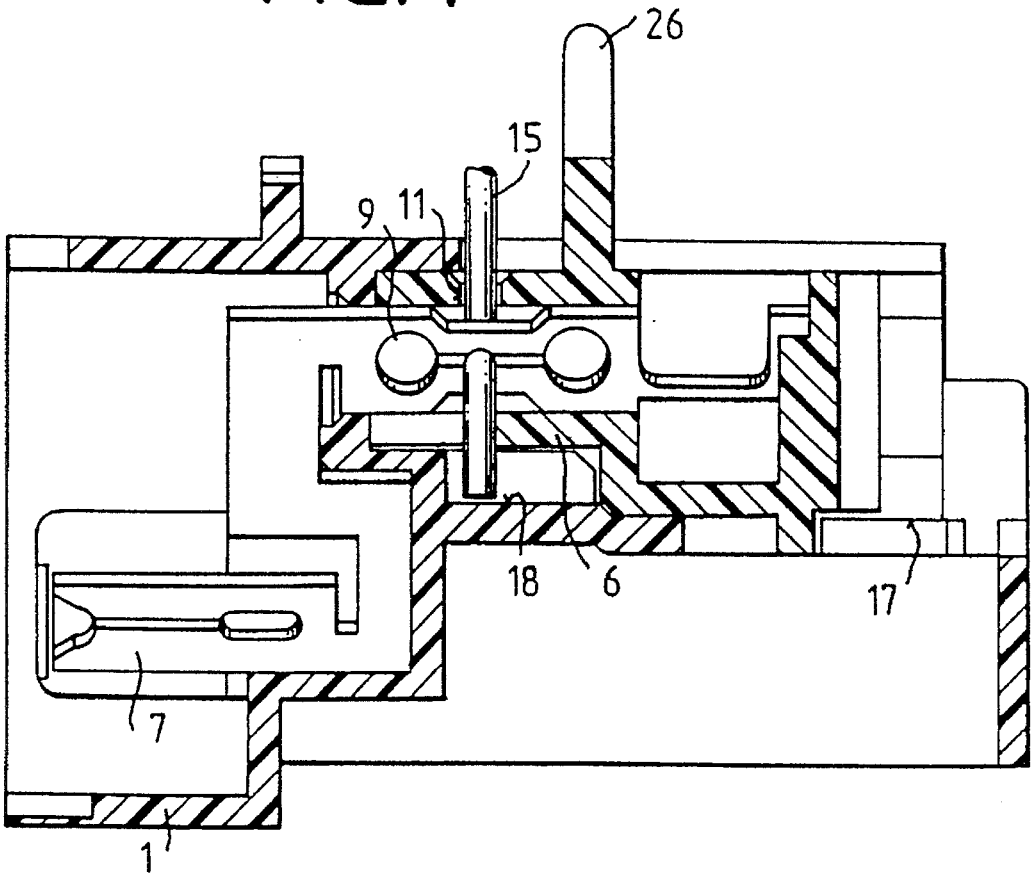
FIG. 4 is a sectional representation of another embodiment of the terminal element.

FIG. 4 shows, in a sectional representation, another embodiment of the terminal element with a sliding part 6.

This embodiment differs from the embodiment of FIGS. 1 to 3 by the configuration of the sliding part 6. The electrical conductor 15 is inserted from above into the sliding part 6. For this purpose, the sliding part 6 is pulled rightwardly by a lever arm 26 up to a stop edge 17. In this position of the sliding part 6, the opening 11 in the sliding part 6 and the borehole 9 in the insulation displacement contact element 7 coincide. The electrical conductor 15 can enter up to the stop wall 18. The stop wall 18 at the receiving part 1 determines the insertion depth for the electrical conductor 15. After introduction of the electrical conductor 15 into the sliding part 6, the latter is pulled leftwardly into the sliding part 6 by means of the lever arm 26 up to the position shown in FIG. 4. Thereby an electrical connection between the conductor 15 and the insulation displacement contact element 7 is established by the contact slot 10.

Figure 6:
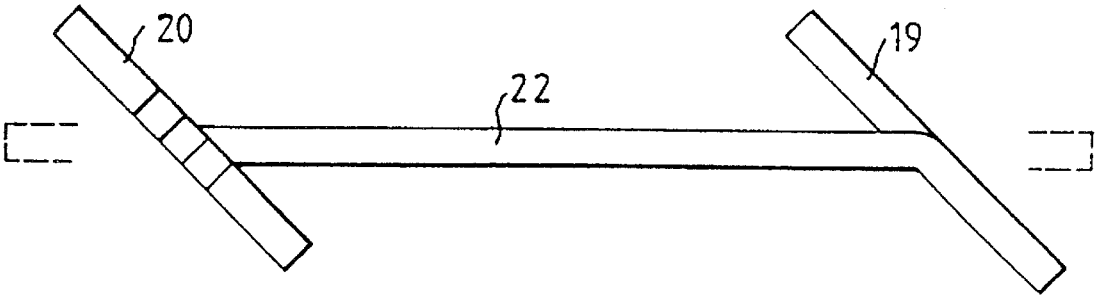
FIG. 6 the side view of the insulation displacement contact element of FIG. 6.
Figure 5:
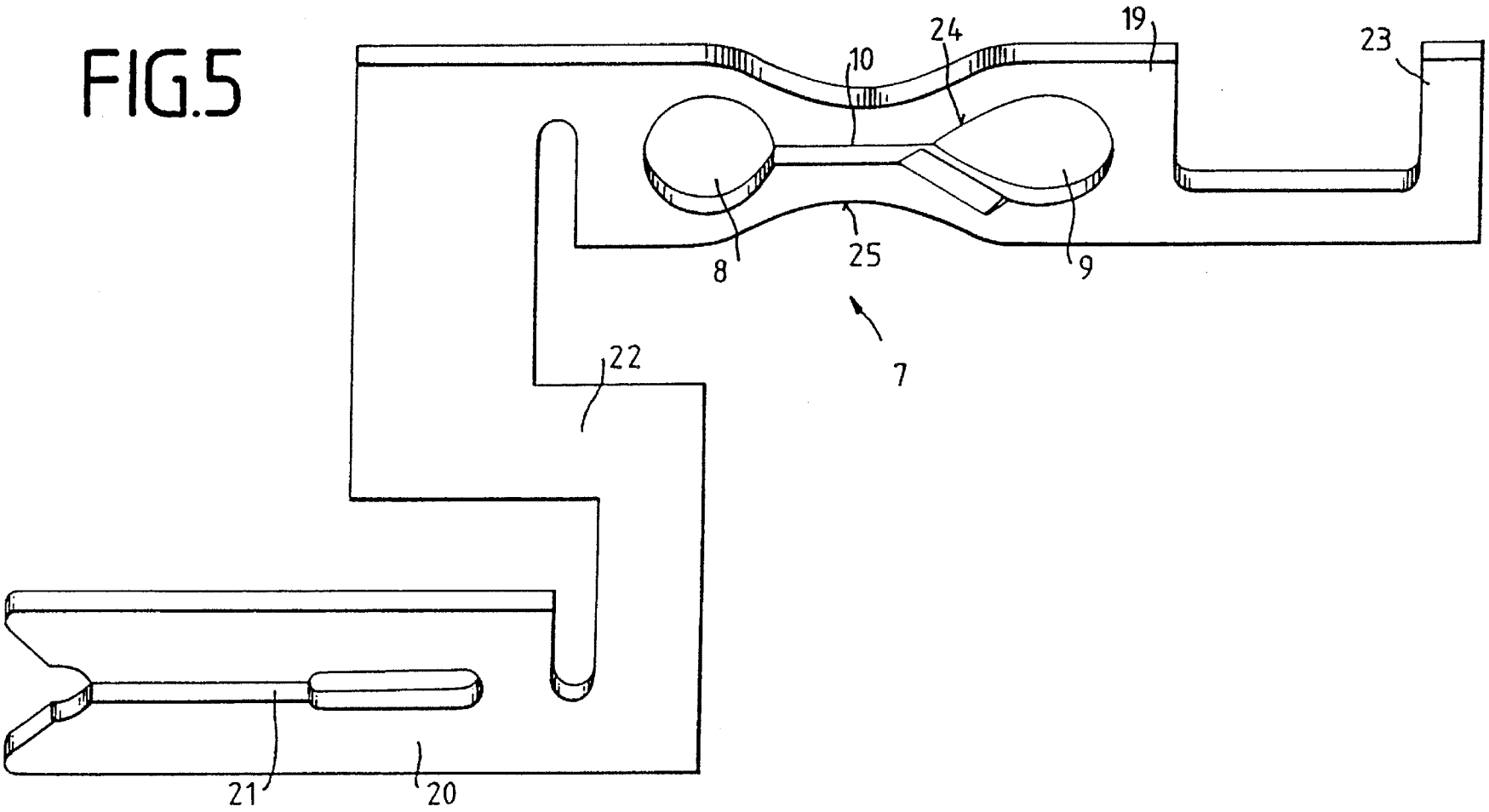
FIG. 5 is a front view of another insulation displacement contact element.

The insulation displacement contact element 7 used for this embodiment is provided, according to the representations in FIG. 5 and 6, on the user side with a closed insulation displacement contact 19 and on the system side with a conventional insulation displacement contact 20.

The insulation displacement contact 20 with the contact slot 21 is connected as one piece by the connection web 22 with the closed insulation displacement contact 19. The insulation displacement contact 20 and the closed insulation displacement contact 19 are each disposed in a 45 degree position relative to the connection web 22 (FIG. 6). The closed insulation displacement contact 19 is self-supporting, and is arranged free-supportingly in the sliding part 6. After contact with the electrical conductor 15, it is not necessary that the insulation displacement contact 19 is supported in or at the sliding part 6, the occurring contact forces are absorbed by the insulation displacement contact 19 itself.

The insulation displacement contact 19 consists of a contact slot 10 with the drop-type borehole 9 for receiving the electrical conductor 15 and with a borehole 8 for the defined selection of the contact force. The insulation displacement contact element 7 further comprises at its end a tapping portion 23 for the connection of the insulation displacement contact element 7 with a test means, e.g. a test terminal.

The contact slot 10 of the insulation displacement contact 19 is configured with inclined introduction portions 24 in the inner area of the borehole 9 and by material cutouts in the area 25 of the contact slot 10 between the boreholes 9, 8, so that the forces required for establishing contact with the electrical conductor 15 are optimized.

While specific embodiments of the invention have been shown and described in detail to illustrate the application of the principles of the invention, it will be understood that the invention may be embodied otherwise without departing from such principles.

What is claimed is:

1. A terminal element comprising:

a housing defining a chamber and defining a housing opening for receiving a conductor;

an IDC element positioned in said chamber, said IDC element defining a contact slot and an access portion;

a slider movably positioned in said chamber, said slider being movable between a first position and a second position, said slider defining a slider opening for receiving a conductor, said slider opening being positioned adjacent said housing opening and said access portion in said first position, said slider opening being positioned adjacent said contact slot in said second position;

movement means for moving said slider between said first and second positions, said movement means being operatable from outside said housing, said movement means including a notch defined by said slider and a movement opening defined by said housing.

2. A terminal element in accordance with claim 1, wherein:

said notch and said movement opening are shaped to cooperate with a lever to move said slider.

3. A terminal element in accordance with claim 1, wherein:

said IDC element is formed in a plane angled substantially 45 degrees to an axis of the conductor.

4. A terminal element in accordance with claim 1, wherein:

a second IDC element with another contact slot and another access portion is connected to said first IDC element by a web.

5. A terminal element in accordance with claim 1, wherein:

said access portion is formed by a first borehole at one end of said contact slot, said IDC element also includes another borehole positioned at another end of said contact slot, said first borehole, said second borehole, and said contact slot being closed and self-supporting.

6. A terminal element in accordance with claim 1, wherein:

said access portion is formed by a first borehole at one end of said contact slot, said IDC element also includes another borehole positioned at another end of said contact slot, said first borehole, said second borehole, and said contact slot being closed and self-supporting;

a second IDC element with another contact slot and another access portion is connected to said first IDC element by a web said first IDC element and said second IDC element are formed in a plane angled substantially 45 degrees to an axis of said web.

7. A terminal element in accordance with claim 6, wherein:

a tapping portion is connected to an end of said IDC element substantially opposite said web.

8. A terminal element comprising:

a housing defining a chamber and defining a housing opening for receiving a conductor;

a first IDC element positioned in said chamber, said first IDC element defining a first contact slot and a first access portion;

a second IDC element with a second contact slot and a second access portion connected to said first IDC element by a web;

a slider movably positioned in said chamber, said slider being movable between a first position and a second position, said slider defining a slider opening for receiving a conductor, said slider opening being positioned adjacent said housing opening and said access portion in said first position, said slider opening being positioned adjacent said contact slot in said second position;

movement means for moving said slider between said first and second positions, said movement means being operatable from outside said housing.

9. A terminal element in accordance with claim 8, wherein:

said movement means includes a notch defined by said slider and a movement opening defined by said housing.

10. A Terminal clement in accordance with claim 8, wherein:

said housing defines another chamber with another slider, said slider and said another slider being positioned adjacent and aligned with each other.

11. A terminal element in accordance with claim 8, further comprising:

locking means for locking said slider in one of said first and second positions.

12. A terminal element in accordance with claim 8, wherein: said movement means includes an arm extending outward from said housing.

13. A terminal element comprising:

a housing defining a chamber and defining a housing opening for receiving a conductor;

an IDC element positioned in said chamber, said IDC element defining a contact slot and an access portion, said access portion being formed by a first borehole at one end of said contact slot, said IDC element also including another borehole positioned at another end of said contact slot, said first borehole, said second borehole, and said contact slot being closed and self-supporting;

a slider movably positioned in said chamber, said slider being movable between a first position and a second position, said slider defining a slider opening for receiving a conductor, said slider opening being positioned adjacent said housing opening and said access portion in said first position, said slider opening being positioned adjacent said contact slot in said second position;

movement means for moving said slider between said first and second positions, said movement means being operatable from outside said housing.

14. A terminal element in accordance with claim 13, wherein:

said IDC element defines material cutouts adjacent said contact slot and between said first and second boreholes.

15. A terminal element in accordance with claim 13, wherein: said access portion includes surfaces inclined toward said contact slot.

16. A terminal element in accordance with claim 13, wherein:

said slider and said IDC element form means for moving the conductor in said slider opening and said access portion into said contact slot.

17. A terminal element in accordance with claim 13, wherein:

said slider defines a longitudinal bore with openings at longitudinal ends of said slider for said IDC clement to pass through and extend out of said openings.

* * * * *